US007980866B2

(12) United States Patent
Bethaeuser

(10) Patent No.: US 7,980,866 B2
(45) Date of Patent: Jul. 19, 2011

(54) PLUG-IN CONNECTOR COMPRISING A MODIFIED INSULATOR DUCT FOR SHIELDING ELECTROMAGNETIC RADIATION

(75) Inventor: Friedhelm Bethaeuser, Munich (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 0 days.

(21) Appl. No.: 12/678,624

(22) PCT Filed: Aug. 26, 2008

(86) PCT No.: PCT/EP2008/006985

§ 371 (c)(1),
(2), (4) Date: May 4, 2010

(87) PCT Pub. No.: WO2009/036865

PCT Pub. Date: Mar. 23, 2009

(65) Prior Publication Data

US 2010/0240254 A1 Sep. 23, 2010

(30) Foreign Application Priority Data

Sep. 17, 2007 (DE) ..... 10 2007 044 338

(51) Int. Cl.
*H01R 13/648* (2006.01)

(52) U.S. Cl. ..... 439/101

(58) Field of Classification Search ..... 439/607.01, 439/607.05, 101, 181, 108; 361/220
See application file for complete search history.

(56) References Cited

U.S. PATENT DOCUMENTS

| | | | | |
|---|---|---|---|---|
| 4,711,506 | A | 12/1987 | Tanaka | |
| 4,824,377 | A | 4/1989 | De Burro | |
| 5,256,074 | A * | 10/1993 | Tan et al. | 439/108 |
| 5,567,169 | A | 10/1996 | McCleerey et al. | |
| 6,074,225 | A * | 6/2000 | Wu et al. | 439/101 |
| 6,447,316 | B1 * | 9/2002 | Jon et al. | 439/181 |
| 2002/0086568 | A1 | 7/2002 | Figueroa et al. | |

FOREIGN PATENT DOCUMENTS

| | | | |
|---|---|---|---|
| DE | 92 17 460 | U1 | 2/1993 |
| DE | 20 2006 015 908 | U1 | 2/2007 |
| EP | 0 563 942 | A2 | 10/1993 |
| EP | 0 718 928 | A2 | 6/1996 |
| EP | 0 762 555 | A1 | 3/1997 |

OTHER PUBLICATIONS

International Preliminary Report on Patentability, PCT/EP2008/006985, Jun. 10, 2010, pp. 1-8.
International Search Report, WO 2009/036865 A3, Mar. 13, 2009, pp. 1-8.

* cited by examiner

*Primary Examiner* — Alexander Gilman
(74) *Attorney, Agent, or Firm* — Ditthavong Mori & Steiner, P.C.

(57) ABSTRACT

A plug-in connector (1, 1', 1'', 1''') is provided that includes an insulator duct (2, 2', 2'', 2''') which forms one or more additional openings (3, 3', 3''') for conducting terminals (4, 4', 4'', 4''') and at least two contact areas (5.1, 5.1', 5.1'', 5.1''', 5.2, 5.2'). A conductor arrangement (6, 6', 6'') which reduces the minimum non-conducting cross-sectional area of the insulator duct (2, 2', 2'', 2''') and is connected in a conducting manner to the housing (8, 8', 8'') is formed in and/or on the insulator duct (2, 2', 2'', 2''').

20 Claims, 4 Drawing Sheets

PLUG-IN CONNECTOR COMPRISING A MODIFIED INSULATOR DUCT FOR SHIELDING ELECTROMAGNETIC RADIATION

CROSS-REFERENCE TO RELATED APPLICATION

The present application is a national phase application of PCT Application No. PCT/EP2008/006985, filed on Aug. 26, 2008, and claims priority to German Patent Application No. 10 2007 044 338.4, filed on Sep. 17, 2007, the entire contents of which are herein incorporated by reference.

BACKGROUND OF THE INVENTION

1. Field of the Invention

The invention relates to a plug-in connector with an insulator duct disposed at least partially within a housing.

2. Discussion of the Background

Plug-in connectors are mechanical components, which realize a conducting connection on the physical layer. The individual plug-in connectors are conventionally specially adapted to the physical properties of the cable, to its technical, transmission-related parameters and uses. In the following description, the term "plug-in connector" includes plugs as well as sockets.

Plug-in connectors are used for various purposes in housings conducting for the reduction of electromagnetic radiation or more generally fixed in or on conducting plug carriers, which can also serve as the earth terminal. Fixed in or on such plug carriers, the fixed connectors can be connected to loose and/or otherwise similarly fixed complementary connectors. In particular, standardised connectors or respectively plug-in connectors for the connection of computers to peripheral devices, which are referred to as trapeze connectors, D-sub connectors, USB-A plug connectors or USB B connectors, EURO network connectors or as TMC connectors, are known from computer technology. LAN, TAE, SFP housings and connectors for optical transmitters, CF (Compact Flash) are further examples. In principle, the invention can be applied to almost all plug-in connectors apart from, for example, coaxial plug-in connectors.

A plug-in connector is known from the utility model specification DE 2006 015 908 U1, in which an insulator duct consisting of a synthetic-material element, which forms several openings for conducting terminals, for example, electrical lines, and at least two outer surfaces, is surrounded by a conducting plug-in connector housing, which leaves open at least two outer surfaces of the insulator duct. The use of an insulator element manufactured from an electrically insulating material for the formation of the insulator duct is also known from this utility model specification.

Within the known plug-in connector itself, a non-conducting cross-sectional area is formed within a duct between a first and a second outer surface, wherein the conducting terminal is formed within the said insulator duct between the first and the second outer surface. Electromagnetic radiation can pass through this non-conducting cross-sectional area of the insulator duct from the one contact surface to the other. The larger the non-conducting cross-sectional area within the duct, the smaller will be the radiation frequency, from which the radiation can penetrate the said non-conducting cross-sectional area in order to pass from one outer surface to the other outer surface, and is finally emitted. The connectors known from the prior art have the disadvantage that they provide large non-conducting cross-sectional areas and accordingly allow a broad spectrum of electromagnetic radiation to pass. For example, a housing with connectors fixed in cut-outs in the housing cannot provide an optimum shielding from emitted electromagnetic radiation. In particular, in view of future, more stringent test conditions up to high frequencies, it will be difficult to observe the limit values.

SUMMARY OF THE INVENTION

Embodiments of the invention therefore advantageously provide a plug-in connector, which shields electromagnetic radiation in an improved manner.

The plug-in connector provides an insulator duct, which forms at least two outer surfaces and at least one opening for a conducting terminal. In and/or on the insulator duct, a conductor arrangement is formed, which reduces the minimum non-conducting cross-sectional area of the insulator duct and which is connected in a conducting manner with a conducting plug-in connector housing. The insulator duct is disposed at least partially within the plug-in connector housing of the plug-in connector. By minimizing the non-conducting cross-sectional area of the insulator duct, the insulator duct becomes impenetrable by increasingly high frequencies of electromagnetic radiation. An emission of electromagnetic radiation, for example, from a measuring device is therefore reduced. In particular, the plug-in connector according to the invention provides the advantage that a shielding is achieved even when the plug-in connector is open. The attachment of conducting covering caps, on plug-in connectors of a device which are not in use, is therefore not required. This has a significant effect even at frequencies, for example, of 1-10 MHz, which are typical for switched-mode power supplies.

It is advantageous if at least a portion of the insulator duct contains an insulator element, because this insulator element allows, for example, a mechanical and electrically-insulating stabilisation or respectively fixing of a conducting terminal, which is formed at one end by the contact pins of the plug-in connector.

If the conductor arrangement consists of several conductor components preferably not connected to one another in a directly conducting manner, the various conductor components connected to one another indirectly in an conducting manner, for example, via the conducting housing of the plug-in connector, can be arranged in an advantageous relative position and orientation, in order to simplify the manufacturing process. Accordingly, for example, two wide-mesh metallic meshes can be arranged one behind the other, offset relative to one another in such a manner that the total non-conducting cross-sectional area, for example, when viewing a projection of the insulator duct, is minimized. Two metallic meshes or plates, which each cover only one half of the non-conducting cross-section of the insulator duct, can be arranged in such a manner that, in combination, both cover the entire non-conducting cross-section of the insulator duct, even if they are each disposed in different planes. If both meshes are disposed in different planes, electrical lines, for example, can be guided through the gap formed between them. Instead of the use of meshes or plates, certain regions of the outer surfaces of the insulator duct can also be vacuum-metallized with conducting material in such a manner that the vacuum-metallized regions on the outer surfaces are complementary to one another and the minimum non-conducting cross-sectional area of the insulator duct is minimized. A metal sheet provided with perforations for the passage of contact pins can also be used as a conductor component.

With a level, flat design of a conductor component of the conductor arrangement, the former can be arranged, for example, in a space-saving, material-saving and geometrically favorable manner. For example, by comparison with a metal plate of the same thickness, a fine-meshed wire mesh saves material and still shields a large part of the electromagnetic radiation. Furthermore, the passage of electrical lines through the mesh is facilitated. Through the use of conductor arrangements in plug-in connectors, the emission of radiation is also reduced when the connector is withdrawn from a device. For example, a conductor component of the conductor arrangement can also be arranged on the level outer surface. The presence of a conductor arrangement on the plug-in connector is then externally recognizable.

If different conductor components of the conductor arrangement are arranged in several planes, within the insulator duct, it is possible to respond in a more flexible manner to design needs, and the different components can be matched and/or positioned spatially relative to one another. For example, it can be advantageous in terms of manufacturing technology to extrusion-coat two relatively wide-meshed meshes offset relative to one another within an insulator element as conductor components, because here also, the minimum cross-sectional area of the insulator duct is minimized. Complete enclosure is guaranteed at the same time by the single, relatively wide-meshed mesh, through the injection of the synthetic material.

The formation of at least one conductor component of the conductor arrangement on at least one outer surface of the insulator duct can signal the presence of a conductor arrangement of this kind in the plug-in connector used because of the optical recognizability.

Through the formation of at least one part of the conductor arrangement within the insulator duct, any mechanical damage and/or accidental electrical contact of the at least one conductor component of the conductor arrangement, for example, when plugging in a complementary connector, can advantageously be prevented. This improves the operational safety of the device.

Since the conductor arrangement encloses the openings of the conducting terminals individually in each case, the minimum non-conducting cross-sectional area of the insulator duct is reduced in an optimal manner. In this context, the enclosure can be implemented within a conductor arrangement formed from only one conductor component or also through the cooperation of several conductor components, each of which enclose several openings in themselves.

By preference, at least one part of the conductor arrangement is formed as a mesh, which, with relatively low conductor-material costs, allows a large-area conductor arrangement, which functions as a Faraday cage. Moreover, meshes can be readily outsourced, which reduces the logistic costs of manufacture.

BRIEF DESCRIPTION OF THE DRAWINGS

The invention is illustrated in the drawings with reference to preferred exemplary embodiments and described in greater detail below. The drawings are as follows.

DETAILED DESCRIPTION OF EXEMPLARY EMBODIMENTS OF THE INVENTION

Figure 1:
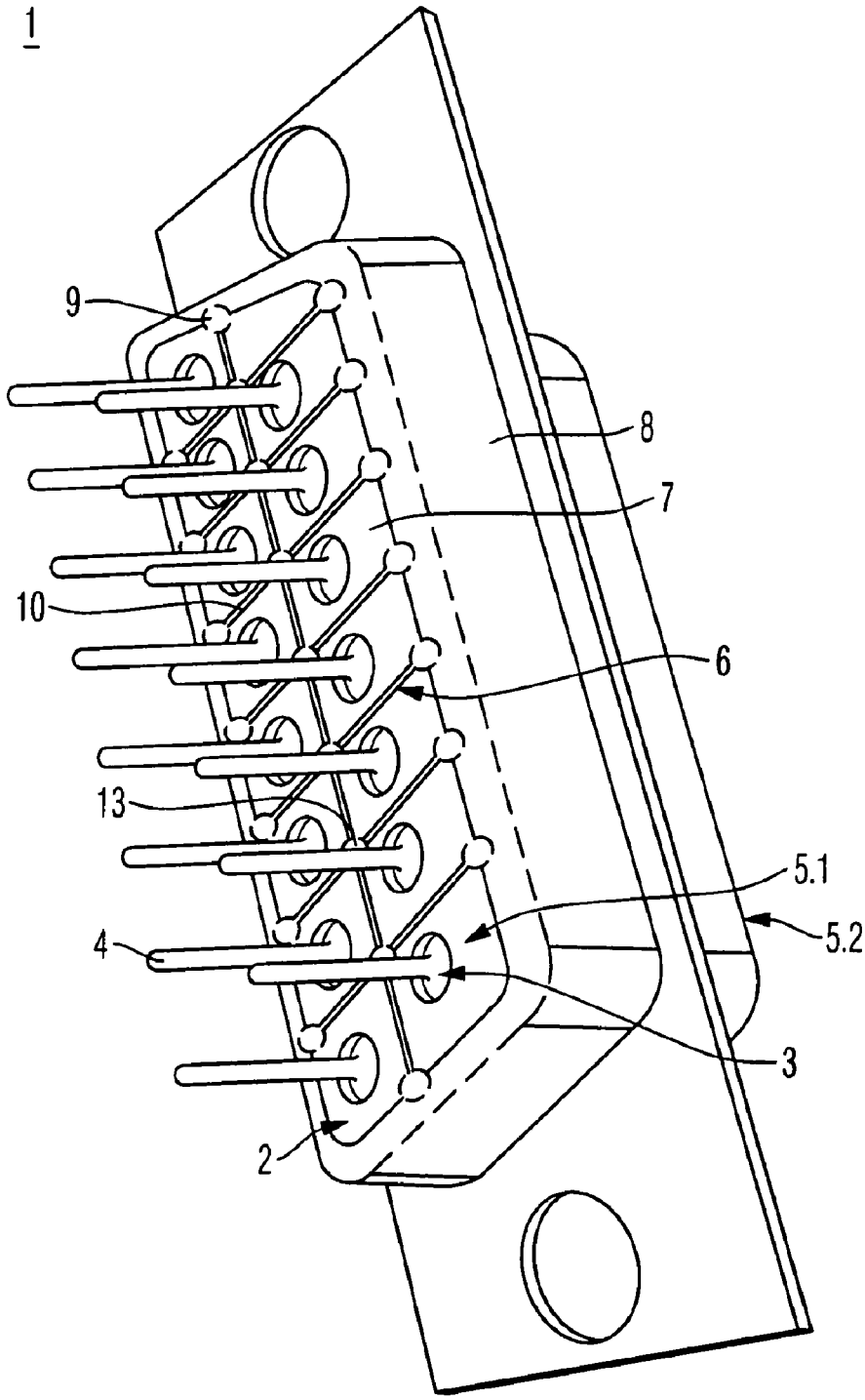
FIG. 1 shows a perspective view of a plug-in connector according to the invention.

FIG. 1 shows a perspective view of a plug-in connector 1 according to the invention. An insulator duct 2, which consists in the exemplary embodiment presented of a synthetic-material insulator element, connects a first and a second outer surface 5.1 and 5.2. The second outer surface 5.2, which is not visible, is disposed in a plane, which is parallel to the plane, in which the illustrated first outer surface 5.1 is disposed. The insulator duct 2 between the outer surfaces 5.1 and 5.2 is surrounded by an electrically conducting housing 8. The insulator duct 2 is filled by the insulator element 7 made of synthetic material, which forms openings 3 for guiding and fixing conducting terminals such as the pins 4 illustrated.

Between the outer surfaces 5.1 and 5.2, the insulator duct 2 forms an non-conducting cross-sectional area, which allows electromagnetic radiation to pass through the first outer surface 5.1, through the insulator duct 2 and through a second outer surface 5.2 or in the opposite direction. In order to reduce this non-conducting cross-sectional area, a mesh made of conducting wires 10 is formed on the first outer surface 5.1, which is attached in an electrically conducting manner via soldering points 9 to the conducting housing 8. Soldering points 9 are also formed at crossings 13 of wires 10, in order to guarantee an electrical connection between the wires 10 as well as the mechanical stability of the mesh. The mesh forms a conductor component. One or more such conductor components, which can be formed in different ways, form the conductor arrangement, which is connected in a conducting manner to the plug-connector housing. Instead of the soldered mesh, a commercially available mesh can also be used, in which the contact is manufactured by the web structure.

Figure 2A:
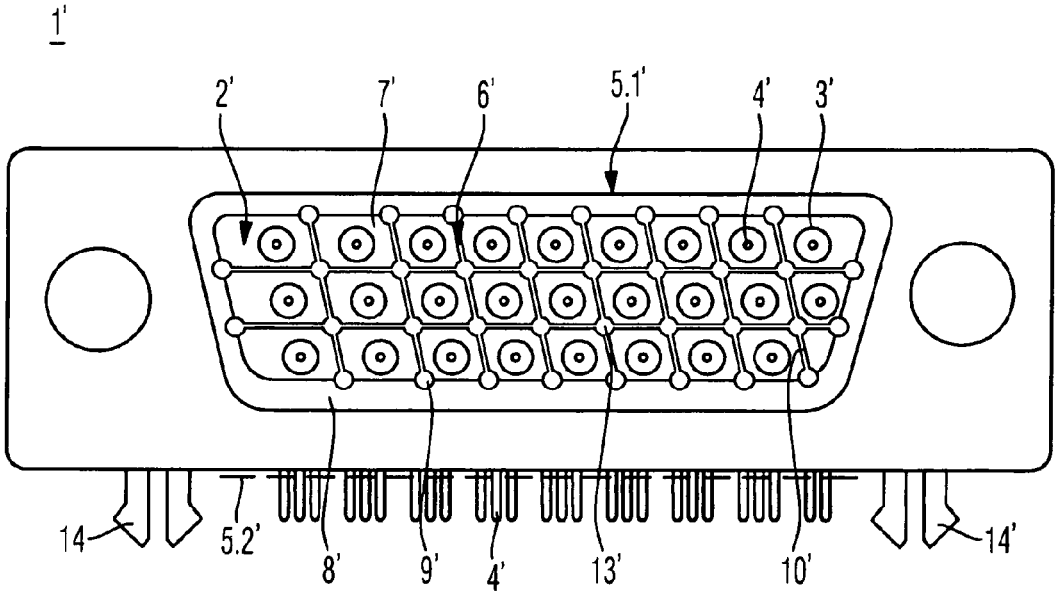
FIG. 2A shows a front view of a second plug-in connector according to the invention.

FIG. 2A shows a front view of a second plug-in connector 1' according to the invention. Like the plug-in connector from FIG. 1, this plug-in connector also provides an insulator duct 2'. This connects the outer surfaces 5.1' and 5.2', which in this exemplary embodiment are not disposed parallel to one another but perpendicular to one another, since the plug-in connector 1' illustrated is provided for assembly on a printed circuit board. The first outer surface 5.1' in this context is surrounded by an electrically conducting housing 8'. The second outer surface 5.2', which is arranged perpendicular to the first outer surface 5, is disposed in a plane parallel to the plane defined by the tips of the ends of the conducting terminals 4', from which the ends of the electrical lines 4' project. The conducting terminals 4' connect the regions close to the outer surfaces 5.1' and 5.2' to one another in an electrically conducting manner. The insulator duct 2' is filled with an insulator element 7' made of synthetic material. This also forms openings 3' for guiding the conducting terminals 4'. The non-conducting cross-sectional area, which fills the insulator duct 2, is reduced in size between the outer surfaces 5.1' and 5.2 by a mesh of conducting wires 10', which is attached in an electrically conducting manner via soldering points 9' to the conducting housing 8'. Soldering points 9' at crossings 13' of wires 10' ensure the mechanical stability of the mesh. The plug-in connector 1 from FIG. 2A provides two snap-in elements 14 and 14', which are fitted into the conducting housing, for the mechanical attachment of the plug-in connector 1, for example, onto a printed circuit board. The ends of the conducting terminals 4', which project from the contact surface 5.2', are arranged in such a manner that they can be inserted, for example, into corresponding recesses, for example, in a printed circuit board.

Figure 2B:
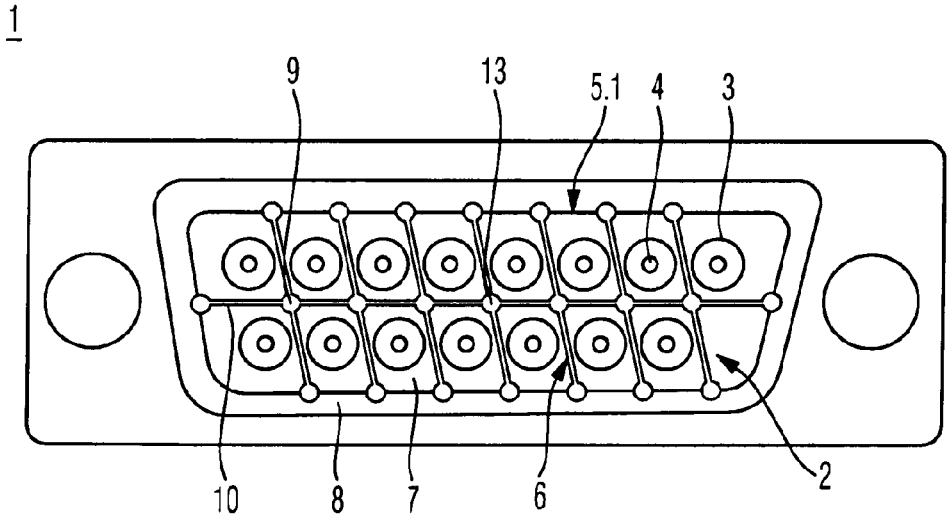
FIG. 2B shows a front view of the plug-in connector according to the invention from FIG. 1.

FIG. 2B shows a front view of the plug-in connector 1 according to the invention from FIG. 1. Reference numbers and content correspond to those from FIG. 1. The description of the drawings has therefore not been repeated.

Figure 3:
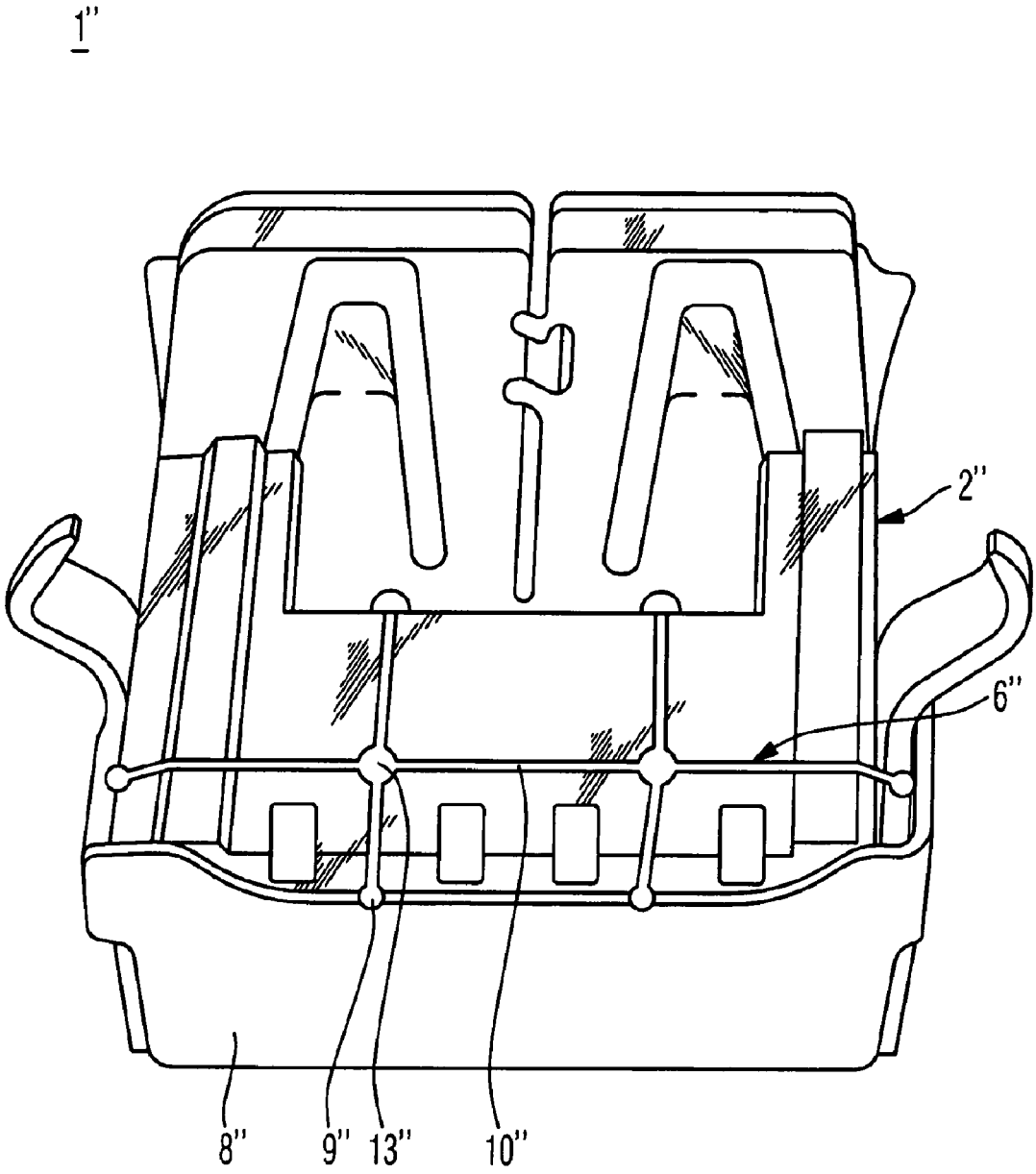
FIG. 3 shows a perspective, plan view of a third plug-in connector according to the invention.

FIG. 3 shows a perspective view of a third plug-in connector 1" according to the invention. In this exemplary embodiment of a plug-in connector 1" according to the invention, the conducting housing 8", which guides the insulator duct 2", which guides the insulator element 7", only partially surrounds the insulator duct 2" and the insulator element 7". In an edge region of the insulator duct 2" and on the surface of the insulator element 7", a mesh of wires 10" is formed as a conductor arrangement, which provides soldering points 9" at the crossings 13" formed by the wires 10" and at the contact points of the wires 10" with the conducting housing 8". The wire mesh defines a plane, of which the non-conducting cross-section is reduced by the wire mesh. This mesh acts as a part of a Faraday cage, which shields mesh-parameter-specific frequencies of the electromagnetic radiation. The entry of electromagnetic radiation from a device into the insulator duct is therefore prevented.

Figure 4:
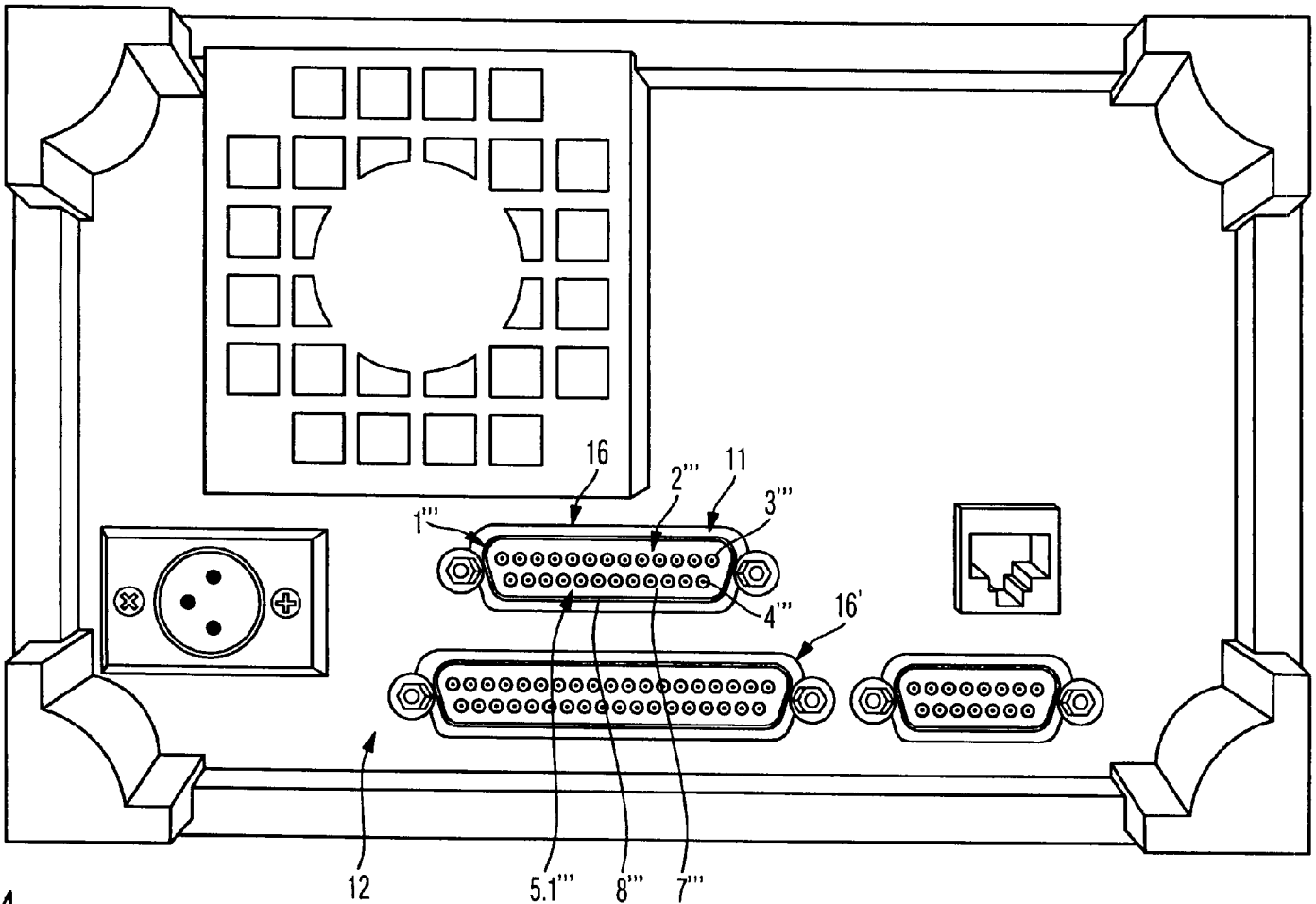
FIG. 4 shows a view of an electronic device housing functioning as a plug carrier.

FIG. 4 shows a view of a rear wall of an electronic-device housing 15 functioning as a plug carrier 12. On the side shown functioning as a plug carrier 12, the electronic-device housing 15 forms apertures 16, 16', through which parts of, for example, plug-in connectors 1'" according to the invention can project. Plug-in connectors 1'" with conducting connector housing 8'" fixed in the plug carrier 12 by means of screws form a conducting contact between the conducting connector housing 8'" and the carrier 12. Accordingly, a conductor arrangement 6 contacted in a conducting manner with the conducting connector housing 8'", whether it is fitted on or in the insulator duct 2'" and on or in an insulator element 7'", is connected to the earth and therefore forms at least one part of a Faraday cage. The conductor arrangement 6 of this kind is not shown in FIG. 4, because it is arranged in the insulator element of the plug-in connectors penetrating the rear wall in each case.

A flange formed on each connector housing can be connected to the plug carrier in a conducting manner by means of a conductive foam element. As an alternative, spring-loaded latches are formed, which contact the plug carrier when the plug-in connector is fitted, thereby providing an earth connection of the plug-in connector housing. On the plug-in connector housing, a contact element for contacting a strip conductor of an earth potential can be additionally provided on the printed circuit board, on which the plug-in connector is disposed.

By way of difference from the exemplary embodiments presented, the insulator duct 2 can also provide a portion not filled with the insulator element. For example, two partial insulator elements, which fix the conducting terminals at both ends of the insulator duct, can then be present. The conductor arrangement can also be disposed in the air gap remaining between the partial insulator elements.

The invention is not restricted to the exemplary embodiment illustrated. On the contrary, combinations of individual features of the exemplary embodiment are also advantageously possible.

The invention claimed is:

1. A plug-in connector comprising, arranged at least partially within a conducting housing, an insulator duct, which forms one or more further openings for conducting terminals and at least two outer surfaces, wherein, in and/or on the insulator duct, a conductor arrangement is formed, which reduces the minimum non-conducting cross-sectional area of the insulator duct and is connected in a conducting manner to the housing, wherein the conductor arrangement consists of several conductor components, wherein at least one conductor component of the conductor arrangement is disposed in one plane, wherein several conductor components are arranged in each case in planes formed at a spacing distance, and wherein the conductor component is formed as a mesh.

2. The plug-in connector according to claim 1, wherein the conductor arrangement is electrically insulated relative to the conducting terminals.

3. The plug-in connector according to claim 1, wherein the conducting housing forms a contact point for a conducting contact with a plug carrier accommodating the plug-in connector.

4. The plug-in connector according to claim 1, wherein the conducting housing forms a conducting contact point for a conducting contact with the earth of the plug carrier in such a manner that the minimum non-conducting cross-sectional area between the plug-in connector and a device housing accommodating the plug-in connector is minimized.

5. The plug-in connector according to claim 1, wherein the insulator duct contains in at least one portion an insulator element.

6. The plug-in connector according to claim 5, wherein at least one conductor component of the conductor arrangement is formed on a contact surface of the insulator duct.

7. The plug-in connector according to claim 5, wherein at least one conductor component of the conductor arrangement is formed in the insulator duct.

8. The plug-in connector according to claim 5, wherein the conductor arrangement surrounds at least one opening for at least one conducting terminal.

9. The plug-in connector according to claim 5, wherein the conductor arrangement is electrically insulated relative to the conducting terminals.

10. The plug-in connector according to claim 5, wherein the conducting housing forms a contact point for a conducting contact with a plug carrier accommodating the plug-in connector.

11. The plug-in connector according to claim 5, wherein the conducting housing forms a conducting contact point for a conducting contact with the earth of the plug carrier in such a manner that the minimum non-conducting cross-sectional area between the plug-in connector and a device housing accommodating the plug-in connector is minimized.

12. The plug-in connector according to claim 1, wherein at least one conductor component of the conductor arrangement is formed on a contact surface of the insulator duct.

13. The plug-in connector according to claim 12, wherein at least one conductor component of the conductor arrangement is formed in the insulator duct.

14. The plug-in connector according to claim 12, wherein the conductor arrangement surrounds at least one opening for at least one conducting terminal.

15. The plug-in connector according to claim 12, wherein the conductor arrangement is electrically insulated relative to the conducting terminals.

16. The plug-in connector according to claim 1, wherein at least one conductor component of the conductor arrangement is formed in the insulator duct.

17. The plug-in connector according to claim 16, wherein the conductor arrangement surrounds at least one opening for at least one conducting terminal.

18. The plug-in connector according to claim 16, wherein the conductor arrangement is electrically insulated relative to the conducting terminals.

19. The plug-in connector according to claim 1, wherein the conductor arrangement surrounds at least one opening for at least one conducting terminal.

20. The plug-in connector according to claim 19, wherein the conductor arrangement is electrically insulated relative to the conducting terminals.

* * * * *